US005297341A

United States Patent [19]

Collins

[11] Patent Number: 5,297,341

[45] Date of Patent: Mar. 29, 1994

[54] LOCKING KNIFE AND SHEATH

[76] Inventor: Walter W. Collins, P.O. Box 100, North, S.C. 29112

[21] Appl. No.: 7,609

[22] Filed: Jan. 22, 1993

[51] Int. Cl.[5] ..... B26B 3/06

[52] U.S. Cl. ..... 30/162

[58] Field of Search ..... 30/151, 159, 158, 157, 30/160, 161, 162; 224/232, 253

[56] References Cited

U.S. PATENT DOCUMENTS

| | | | |
|---|---|---|---|
| 3,246,813 | 4/1966 | Miller | 30/162 |
| 3,381,807 | 5/1968 | Vaughn | 30/162 |
| 5,025,557 | 6/1991 | Perreault | 30/162 |
| 5,123,167 | 6/1992 | Kelley | 30/162 |
| 5,138,768 | 8/1992 | Collins | 30/162 |
| 5,155,911 | 10/1992 | Collins | 30/162 |

*Primary Examiner*—Richard K. Seidel
*Assistant Examiner*—Paul M. Heyrana Sr.
*Attorney, Agent, or Firm*—Leatherwood Walker Todd & Mann

[57] ABSTRACT

A locking knife and sheath combination having a knife of unitary construction. A flexible engagement tab is provided on the handle of the knife for engaging with a tab receiving opening provided in a front portion of the sheath. Upon engagement of the tab with such opening, the knife is securely retained in the sheath. Removal of the knife from the sheath is accomplished by depression of the tab through the tab opening of the sheath. Sheath clamping means are also provided on the opposite side of the sheath and include a clamping arm which pivots with respect to the rearward surface of the sheath through means of rotation of a thumb wheel adjustment member. Rotation of the adjustment member allows for the clamping arm to selectively clamp the sheath to an article.

14 Claims, 4 Drawing Sheets

Fig. 3
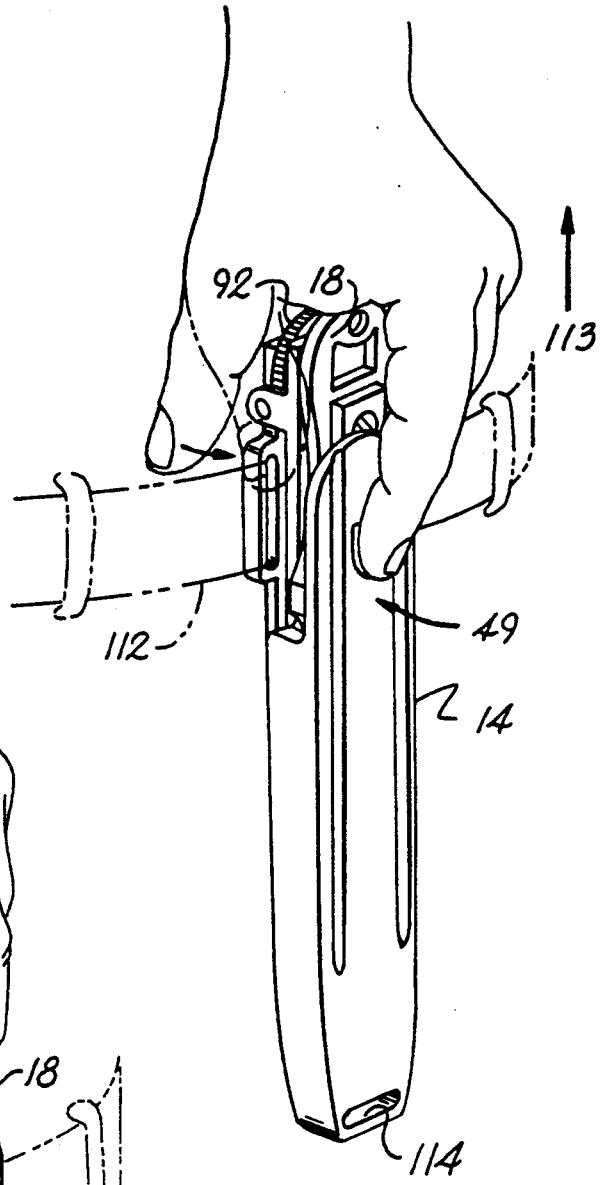
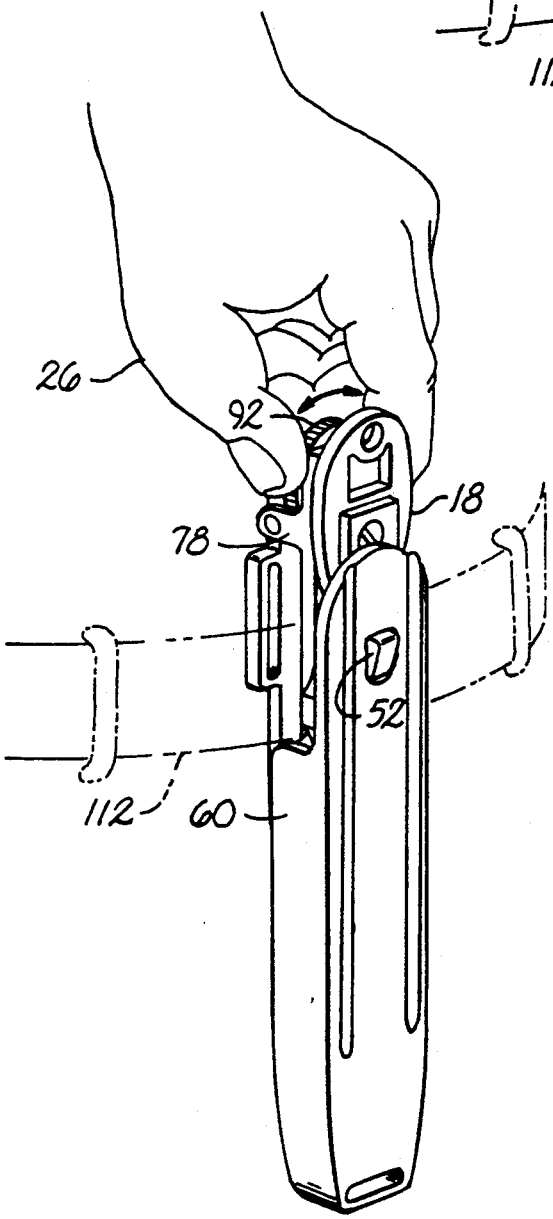
Fig. 4

LOCKING KNIFE AND SHEATH

BACKGROUND OF THE INVENTION

This invention relates generally to a locking knife and sheath combination which is readily attachable to a garment, belt, boot, or the like.

The typical knife includes a metal blade with a handle made from plastic, wood, metal, laminate, or the like, being fixed to the blade in some manner. The handle portion can be molded directly onto a shank, or tang, portion extending from the blade or can be attached to such tang portion by rivets, screws, or some other suitable fasteners. In the manufacturing context, the attachment of a handle to the knife usually requires additional manufacturing steps, which accordingly increases the complexity of manufacture and labor costs in general.

All-metal knifes, where the blade and handle are both provided on a unitary piece of metal, have been produced. Because of the relative ease of manufacture, they can be produced quite economically, in that no separate handle assembly is required. Also, since the separate handle, which could break, become loose, or fall off, is not required, such all-metal knives tend to have advantage in toughness and durability over conventional knives where the knife and handle are not formed integrally from one piece of metal.

However, such one-piece knives have, in the past, had several significant disadvantages. From a subjective standpoint, one-piece all-metal knives are sometimes viewed as being of less quality and value as compared to conventional knives. Perhaps the most significant disadvantage was that the metal handle did not provide a comfortable grip for using the knife. An especially economical method of producing one-piece knives involves stamping or forming them from sheet or bar metal stock. In so doing, however, the handle portion of the knife is of the same general thickness as is the blade portion. This can result in the knife handle being of a relatively thin profile, which, without more, can be uncomfortable to use. The knives offer no cushioning for the handle portion since the handle is rigid and integral with the blade. On the other hand, the relatively thin thickness of the handle provides for a low-profile knife with a reduced bulk, as compared to a conventional knife having an enlarged handle fixed to the blade.

Another feature of conventional knives is that the handle is designed for ambidextrous use, i.e., the knife must be usable by either left or right-handed individuals. Also, depending on the respective orientation between the knife handle and the blade, the knife must sometimes be oriented in a particular manner in order to fit in a sheath, depending on the handle design.

To store a knife, sheathes have been designed which will allow the knife to be quickly removed from the sheath when needed. Other sheaths have been designed which provide a strap, elastic loop, or the like, for engaging the handle to retain the knife within the sheath. Still further, knives have been designed which secure the handle of the knife to the blade-receiving portion of the sheath through a mechanical means. For example, U.S. Pat. No. 2,391,574, issued to Housinger on Sep. 30, 1943, discloses a knife handle having a spring arm riveted to the knife blade. The spring arm includes a locking pin which is received in a notch formed in the sheath.

U.S. Pat. No. 4,404,747, issued to Collins, the inventor of the present invention, on Sep. 20, 1983, discloses a knife having a spring-biased button that is receivable in an opening provided in the sheath. The button is depressed when the knife is inserted into the sheath, and remains depressed until reaching the opening, where it then pops into engagement with the opening to lock the knife in the sheath. U.S. Pat. No. 4,856,192, also issued to Collins, on Aug. 15, 1989, discloses a knife having button portions receivable in a hole defined in the sheath. A leaf spring biases one of the button portions into the hole, depending on how the knife is inserted into the sheath. One embodiment of the patent discloses the use of a button and a coil spring, for allowing the knife to be inserted in a locking position into the sheath in only one way. U.S. Pat. No. 4,964,554, again issued to Collins, on Oct. 23, 1990, discloses a knife being retained in a sheath by a bolt and spring, which are slidably contained within a channel within the sheath.

Another knife and sheath design is provided on a knife sold by Dacor (Hi-Tech Hunting Style Knife 7216-00) which includes a button mounted on the sheath for engaging the knife.

In certain situations, it is necessary to have a knife safely secured within a sheath, while at the same time having the knife quickly removable for use. This could be a need for active persons such as rescue workers, backpackers, climbers, and hunters, etc. This is also a particular need of underwater divers. Divers often require the use of their knives in dark, sometime disorienting, environments. Having a simple yet reliable means for quickly releasing the knife from the sheath can be extremely important.

Sheaths are typically provided with a loop portion or open portion for receipt of a belt worn about the waist of the user, or for receipt of a retaining strap. Such an arrangement typically requires for the user to either remove his or her belt in order to place the sheath on the belt, or requires that the strap have a free end available to be inserted through the strap opening.

Sheath-type devices have been disclosed which may be clipped onto an object. For example, U.S. Pat. No. 125,921, issued to Will, et al. on Apr. 23, 1872, discloses a scabbard having a clasp bar and flat spring which pivot about a plate. The clasp bar is moved through action of a screw contacting the plate, the clasp bar being interposed between the back side of the sheath and the head of the screw. U.S. Pat. Nos. 1,131,669, issued to Bremer, on Mar. 16, 1915, and 4,759,483, issued to Willoughby, on Jul. 26, 1988, disclose other types of sheath attachment means.

While prior sheath attachment configurations are available, they present limitations which often interfere with a low-profile, easy-to-use device.

SUMMARY OF THE INVENTION

It is the principal object of this invention to provide a knife having a blade and handle of integral construction which is comfortable to use.

It is another object of the present invention to provide a knife having a releasable sheath locking structure.

It is another object of the present invention to provide a sheath having means for releasably securing a knife therein.

It is yet another object of the present invention to provide a sheath which can be readily attached to and removed from a belt or other article.

It is another object of the present invention to provide a knife which can be selectively configured for either left-handed or right-handed use.

It is still another object of the present invention to provide a knife which can be simply and economically produced.

These and other aspects of the present invention will become further evident upon reference to the following drawings and accompanying specification.

Generally, one preferred embodiment of the present invention includes a knife and sheath combination, the sheath being usable in association with an article. The knife and sheath combination includes a knife having an elongated unitary member defining a blade portion and a handle portion. The handle portion defines a grip receiving opening, and at least one grip member is provided for receipt in the grip receiving opening. At least one flexible elongated tab member movable with respect to the handle portion is provided, the tab member having a first end adjacent the grip member and a second end opposite the first end of the tab member, the second end of the tab member being cantilevered and free to move with respect to the handle portion. A tab projection is connected to the tab member and extends outwardly from the handle portion.

The sheath has a front portion, a back portion opposite the front portion, and first and second side portions opposite one another and each being connected to the front and back portions. The front and back portions and the first and second side portions together define a blade receiving passage. The back portion has a frontal surface adjacent the receiving passage and a rearward surface opposite the frontal surface. The front portion defines a tab projection opening for receiving the tab projection of the tab member of the knife, such that upon the blade portion being inserted into the blade receiving passage, the tab portion projects outwardly from the front portion of the sheath and releasably engages the tab projection opening to retain the knife in the sheath. Accordingly, the knife is removable from the sheath upon depression of the tab projection into the tab projection opening.

Sheath retention means are provided which are connected to the rearward surface of the back portion of the sheath for selectively retaining the sheath to an article.

More specifically, the sheath retention means may include at least one receiver projecting outwardly from the back portion, and a clamping arm having a first end and a second end. The first end of the clamping arm is pivotally connected to the receiver for pivotal movement with respect to the back portion of the sheath, and the second end of the clamping arm includes an engagement portion projecting outwardly from the second end of the clamping arm and towards the rearward surface of the back portion of the sheath.

The first end of the clamping arm includes a threaded bore, which is adjacent the receiver and opposite the second end of said clamping arm. A threaded adjustment member threadingly engages the threaded bore, with the threaded adjustment member having a purchase portion positioned between the first end of the clamping arm and the rearward surface of the sheath's back portion for contacting the rearward surface of the sheath upon selective rotation of the enlarged portion, and for biasing the engagement member towards the rearward surface of the back portion. This causes the engagement member to grip an article for consequently retaining the sheath on the article.

BRIEF DESCRIPTION OF THE DRAWINGS

The foregoing, as well as other objects of the present invention, will be further apparent from the following detailed description of the preferred embodiment of the invention, when taken together with the accompanying drawings, in which:

FIG. 3 is a perspective view of a locking knife and sheath combination constructed in accordance with the present invention with the knife retention means being shown in use;

FIG. 4 is a perspective view of a locking knife and sheath combination constructed in accordance with the present invention wherein the sheath attachment means is illustrated in use;

DESCRIPTION OF THE PREFERRED EMBODIMENT

Figure 1:
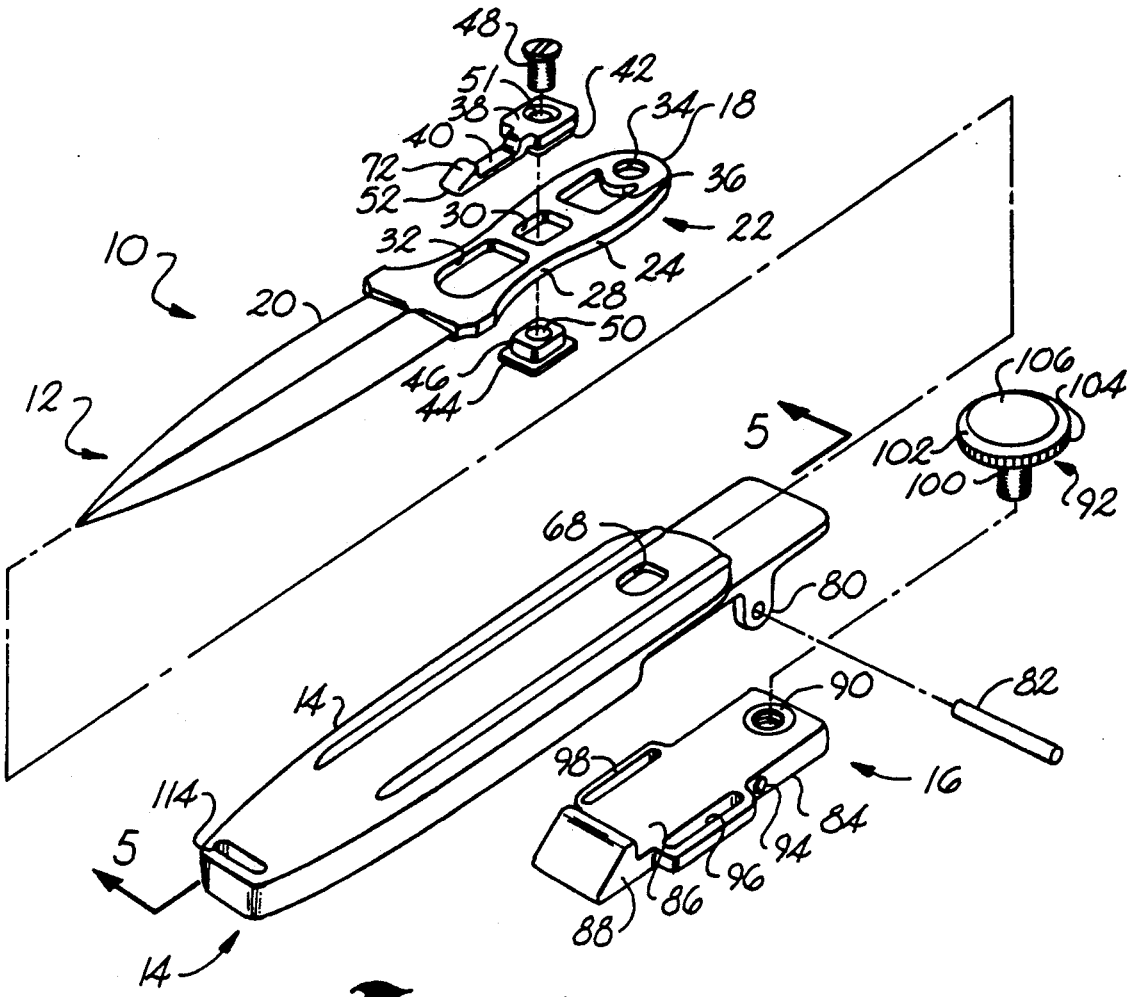
FIG. 1 is an exploded perspective view of a locking knife and sheath combination constructed in accordance with the present invention.

Referring to the drawings in detail, wherein like reference characters represent like elements or features throughout the various views, the locking knife and sheath combination of the present invention is designated generally in the figures by reference character 10.

Referring to FIG. 1 of the drawings, locking knife and sheath combination 10 is illustrated in an exploded view and includes a knife, generally 12, a sheath, generally 14, and sheath retention, or clamping, means, generally 16.

Knife 12 is of unitary construction, with a handle portion 18 and a blade portion 20 being formed on the same piece of material. Knife 12 is preferably constructed of steel, and in particular, of Vasco Max steel, manufactured by Teledyne Allvac/Vasco, of Monroe, N.C., which is of high cobalt content. Alternately, conventional 440 C steel, which is of high carbon content, could be used. It is to be understood, however, that any other suitable cutlery steel or metal could be used instead.

Handle portion 18 defines a grip, generally 22, having a relatively wide portion 24 for being received in the palm of the hand 26 of the user and a tapered-in portion 28 for receipt by the thumb and fingers of the user's hand. Handle portion 18 also defines a grip receiving opening 30 and an elongated tab member receiving opening 32 which will be discussed in more detail below. A utility opening 34 is provided in the end of handle portion 18, through which a lanyard may be placed or for receipt of a nail or peg on which knife 10 may be held. Opening 36 defined in handle portion 18 is for receipt of the meaty portion of the palm of the user's hand, which is adjacent to the thumb, to further stabilize the handle portion 18 within the user's hand during use.

A grip member 38 is provided having an elongated tab member 40 attached thereto. Tab member 40 is preferably molded with grip member 38 to together form one integral piece. Grip member 38 and tab member 40 are preferably constructed of Grivory, sold by American Grilon, Inc., of Sumter, S.C., which is a material with the appearance of ivory. However, any other suitable material, such as wood, plastic, metal, or the like could be used instead. Grip member 38 is generally of a rectangular shape and includes a recessed portion 42 which is received in grip receiving opening 34. A cooperating grip member 44 is provided which is also generally rectangular shaped and includes a recessed portion 46 to be inserted into grip receiving opening 30. Grip members 38, 44 are held within grip receiving opening by means of a screw 48, or other suitable fastener. Cooperating grip member 44 preferably includes a threaded metal bushing 50 molded therein for receipt of screw 48. Grip member 38 includes a smooth bore 51 through which screw 48 passes upon threaded engagement with bushing 50 of cooperating grip member 44.

Tab member 40 is cantileveredly attached to gripping member 38 such that it is readily flexible with respect to handle portion 18 and grip member 38. A ramp-shaped tab projection 52 is provided on the end of tab member 40 opposite where tab member 40 is connected to gripping member 38. Tab member 40 and tab projection 52 are free to move within tab member receiving opening 32, once gripping members 38, 44 are connected together with screw 48. Flexure of tab member 40 within tab member receiving opening 32 is preferably accomplished by the user using his or her finger to depress tab member 40 in a direction as shown by arrow 49 to within opening 32.

Sheath 14 is illustrated in FIGS. 1 through 5, and includes a front portion 54, a back portion 56 opposite front portion 54, and side portions 58, 60 spaced opposite one another, and each being connected to front and back portions, 54, 56. Front and back portions 54, 56 and side portions 58, 60 together form a blade receiving passage 62 in which blade portion 20 of knife 12 is received. Although blade portion 20 is shown in the figures as being double edged, it is to be understood that blade portion 20 could also have only a single cutting edge, if desired.

Figure 2:
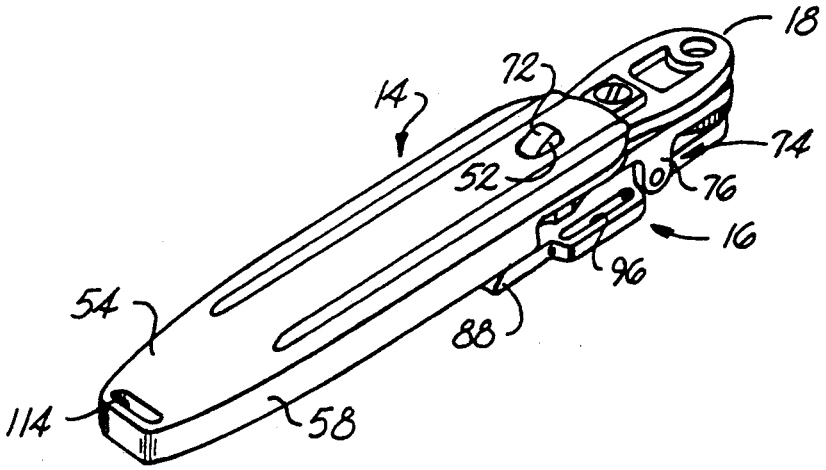
FIG. 2 is a perspective view of a knife and sheath combination constructed in accordance with the present invention.
Figure 5:
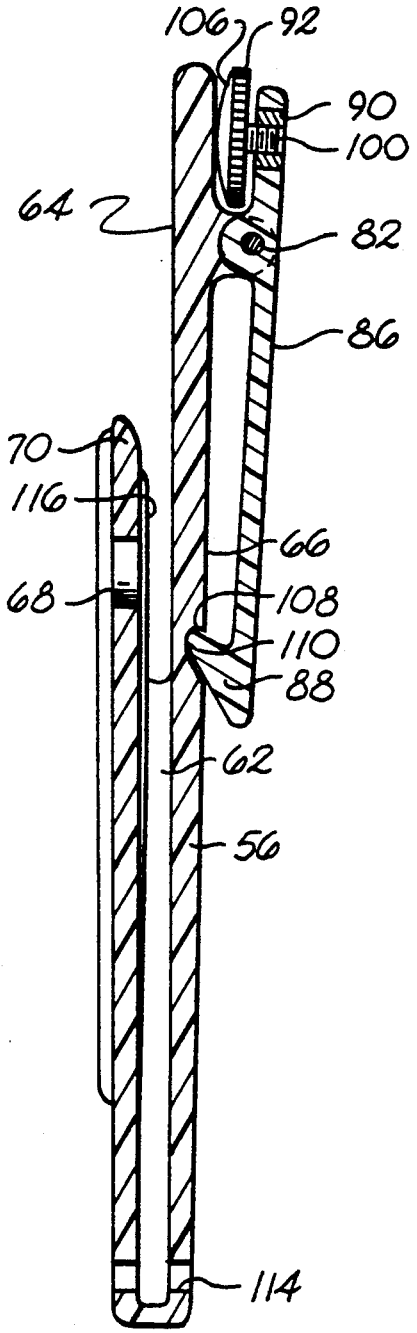
FIG. 5 is a sectional view taken along lines 5—5 of FIG. 1.

Turning to FIG. 5, sheath 14 also includes a frontal surface 64 provided on back portion 56 and a rearward surface 66 also provided on back portion 56, on the opposite side thereof from frontal surface 64. Sheath front portion 54 defines a tab projection opening 68 for receiving tab projection 52 on tab member 40, which is connected to handle portion 18 of knife 12, when knife blade portion 20 is inserted into blade receiving opening 20. An extension portion 70 is provided adjacent tab receiving opening 68 and engages the ramp portion 72 of tab projection 52 upon blade portion 20 being inserted into knife receiving opening 62. In other words, tab projection 52 is automatically depressed by extension portion 70 such that blade 20 may be easily inserted into the sheath. It is only when tab projection 52 reaches tab opening 68 that tab projection 52 springs upwardly within tab projection opening 68. In that position, as illustrated in FIG. 2, tab projection 52 extends outwardly beyond front portion 54 of sheath 14 such that when it is desired to remove knife 12 from sheath 14, the user simply depresses tab projection 52 with his or her finger until projection 52 clears projection opening 68 altogether to allow knife 12 to be removed from sheath 14.

Sheath 14 is preferably constructed of plastic, and in particular of Zytel, a glass-filled nylon, although any other suitable material could be used.

On the opposite side of sheath 14 from tab projection opening 68 is sheath clamping structure 16, which is pivotally connected to a receiver, generally 74, provided on rearward surface 66 of sheath back portion 56. Receiver 74 includes arms 76, 78 extending outwardly from rearward surface 66 and includes bores 80 for receipt of a pin 82. A clamping arm 84 is provided having an elongated portion 86 and an engagement member 88, of a generally ramped-shape. Opposite the end of elongated portion 86 having engagement member 88, a threaded bushing 90 is provided in elongated portion 86 for receipt of a threaded adjustment member, or thumbwheel screw, generally 92. Elongated portion 86 also includes a bore 94 running transversely there through before receipt of pin 82. Further, elongated portion 86 includes slots 96, 98 through which a strap, belt, or like may be passed for retention of sheath 14 thereto.

Thumbwheel screw 92 includes a threaded portion 100 and an enlarged head portion 102 having ridges 104 defined in its circumference. Thumbwheel screw 92 includes a contact surface 106 which bears against rearward surface 66 of the back portion 56 on the sheath when thumbwheel screw 92 is rotated in a counter-clockwise direction (as seen facing contact surface 106). Through the bearing of contact surface 106 against rearward surface 66, clamping arm 84 is caused to pivot about pin 82 such that engagement member 88 approaches and engages rearward surface 66 of the sheath. As shown in FIG. 5, a recess, or indentation, 108 may be provided in back portion 56 for receiving engagement member 88. Engagement member also includes a rounded nose portion 110 which seats within recess 108. The rounded surface of nose portion 110 reduces the snagging of engagement member 88 on an article when sheath 14 is removed from the article.

In attaching sheath 14 to the article, such as a belt, boot, backpack, or the like, thumbwheel screw 92 is rotated in a clockwise direction such that engagement member 88 pivots away from sheath back portion 56. This provides for clearance to receive the article, such as a belt 112, which is shown for illustration purposes only, in FIGS. 3 and 4. Sheath 14 is then moved downwardly such that clamping arm 84 extends adjacent one side of belt 112 and sheath back portion 66 extends adjacent the other side of belt 112. Thumbwheel screw 92 is then rotated in a counter-clockwise direction with the user's thumb or forefinger to bring engagement member 88 to bear against belt 112, or, if engagement member 88 clears belt 112, into recess 108. If engagement member 88 does not clear belt 112, and thumbwheel 92 is advanced in a counter-clockwise direction, then belt 112 will be forced slightly into recess 108 such that sheath 14 is securely retained to belt 112.

To release sheath 14 from belt 112, thumbwheel screw 92 is simply rotated in a clockwise direction such that clamping arm 84 pivots away from sheath rearward surface 66, and engagement member 88 clears belt 112 to allow sheath 14 to be lifted upwardly, in a direction as indicated by arrow 113. Accordingly, it can be seen that sheath 14 can be attached to and removed from the user's belt while the user is wearing the belt, without requiring that the user unbuckle and partially remove his or her belt. It can also be seen that the sheath clamping structure 16 can be readily used to clamp sheath 14 to articles other than belts, such as boot uppers, pockets, straps, etc.

Accordingly, sheath 14 can be attached to an article using just one hand, and knife 12 can also be locked into place within sheath 14 and quickly removed from the sheath using just one hand. Sheath 14 also includes at one end a strap-receiving opening 114 for receiving a strap or lanyard, for example, to be used in strapping the lower end of sheath 14 to a user's leg or another object, if desired. Also, openings 96, 98 can be used to attach sheath 14 to a strap in addition to, or in lieu of, use of clamping arm 84 for sheath retention.

As illustrated in FIG. 5, blade receiving passage 62 of sheath 14 preferably includes longitudinally extending ridges 116 (only one being shown) which define guide-ways for guiding blade portion 20 into blade receiving opening 62.

A significant feature of knife 12 is the ambidextrous nature afforded by gripping members 38, 44 acting in conjunction with handle portion 18. Gripping members 38, 44 may be configured, when blade portion 20 is of a single edge design, to be most comfortable for either left or right-handed use by simply reversing gripping members 38, 44 to opposite sides of handle portion 18. Alternately, if knife 12 is of a double-edge design, with the edges being of different configurations with respect to one another (for example, one edge being straight and the other edge being serrated), the particular desired orientation of the knife within the sheath can be selected by selecting the orientation of gripping members 38,40. Because tab member opening 32 and grip receiving opening 30 extends all the way through handle portion 18, reversal of grip members 38, 44 would not affect the operation of the tab locking feature for retaining knife 12 within sheath 14.

The knife design of the present invention can be manufactured relatively simply. Because the handle portion 18 and blade portion 20 are all one piece, the conventional steps of permanently fixing a separate handle member to the knife tang portion can be minimized. Gripping members 38, 44 are simply attached to handle portion 18 by means of screw 48. Obviously, knife 12 could be used without gripping members 38, 44, if desired.

Figure 6:
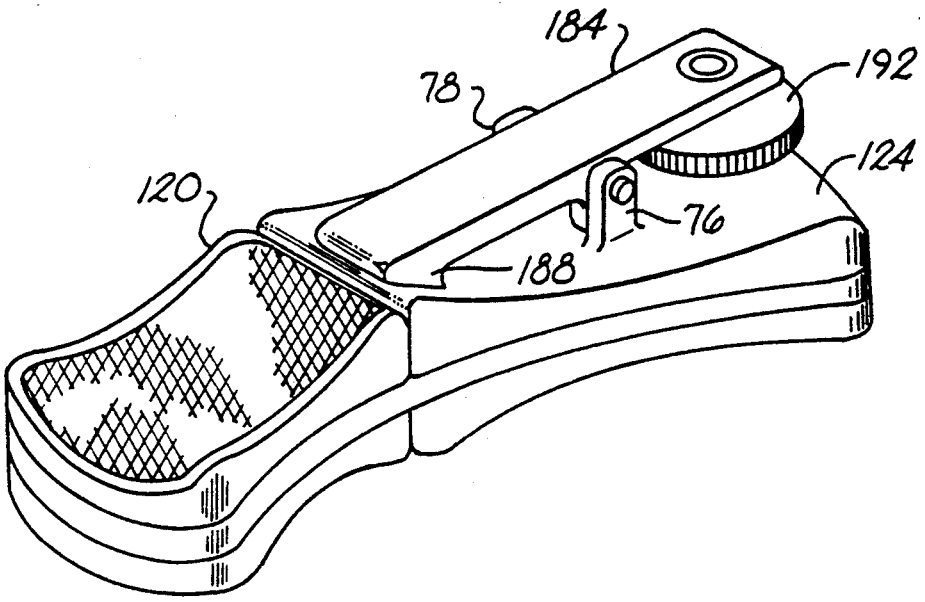
FIG. 6 is a perspective view of an alternate embodiment wherein means are provided for attaching a folding knife to an article.

An alternate embodiment of the sheath clamping structure is illustrated in FIG. 6 as applied to a folding knife 120. Folding knife 120 includes a clamping structure substantially the same as that disclosed above with regards to sheath 14, and includes a clamping arm 184 pivotally carried on receiver arms 76, 78. A thumbwheel screw 192 is threadingly carried in one end of clamping arm 184, and when rotated, bears against an outer surface 124 of pocket knife 120. The bearing of thumbwheel screw 192 against outer surface 124 causes engagement member 188 to move against outer surface 124 for clamping folding knife 120 to an article, a portion of which would be disposed between outer surface 124 and engagement member 188. Accordingly, operation of clamping structure 116 is substantially the same as that discussed above regarding clamping structure 16 used in conjunction with a sheath 14.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art, without departing from the spirit or scope of the following claims.

What is claimed is:

1. A knife and sheath combination, the sheath being usable in association with an article, the knife and sheath combination comprising:

a knife having a blade portion and a handle portion which are unitary; said handle portion being adjacent said blade potion; said handle portion being of substantially the same thickness as said blade portion adjacent thereto and defining a grip receiving opening; at least one detachable and reversible grip member for receipt in said grip receiving opening; at least one flexible elongated tab member movable with respect to said handle portion for left and right handed use, said tab member having a first end adjacent said grip member and a second end opposite said first end of said tab member, said second end of said tab member being cantilevered and free to move with respect to said handle portion; and a tab projection connected to said tab member extending outwardly from said handle portion; said handle portion further defining a tab member receiving opening passing through said handle portion and adjacent said grip receiving opening, said tab member receiving opening being for receipt of said tab member and for allowing movement of said tab member therein;

a sheath having a front portion, a back portion opposite said front portion, and first and second side portions opposite one another and each being connected to said front and back portions; said front and back portions and said first and second side portions together defining a blade receiving passage; said back portion having a frontal surface adjacent said receiving passage and a rearward surface opposite said frontal surface; said front portion defining a tab projection opening for receiving said tab projection of said tab member of said knife, such that upon said blade portion being inserted into said blade receiving passage, said tab projection projects through said tab projection opening and outwardly from said front portion of said sheath, such that said tab projection releasably engages said tab projection opening to retain said knife in said sheath; said knife being removable from said sheath upon depression of said tab projection inwardly into said tab projection opening; and sheath retention means connected to said rearward surface of said back portion of said sheath for selectively retaining said sheath to an article.

2. The knife and sheath combination as defined in claim 1, further comprising said front portion of said sheath defining an extension portion which extends adjacent to and substantially covers said tab member upon said blade portion being received in said blade receiving passage and said tab projection being received in said tab projection opening.

3. A knife and sheath combination as defined in claim 1, further comprising said back portion of said sheath defining at least one strap receiving opening for receiving a strap therein.

4. The knife and sheath combination as defined in claim 1, wherein said sheath retention means includes at least one receiver projecting outwardly from said back portion; a clamping arm having a first end and a second end, said first end of said clamping arm being pivotally connected to said receiver for pivotal movement with respect to said back portion of said sheath; said second end of said clamping arm including an engagement portion projecting outwardly from said second end of said clamping arm and towards said rearward surface of said back portion of said sheath; said first end of said clamping arm defining a threaded bore adjacent said receiver and opposite said second end of said clamping arm; a threaded adjustment member threadingly engaging said threaded bore; said threaded adjustment member having a purchase portion positioned between said first end of said clamping arm and said rearward surface of said back portion and contacting said rearward surface of said sheath upon selective rotation of said enlarged portion, thereby biasing said engagement member towards said rearward surface of said back portion for gripping an article therebetween and for retaining the sheath on the article.

5. A knife and sheath combination as defined in claim 4, wherein said threaded adjustment member is a thumbwheel screw, and wherein said purchase portion of said threaded adjustment member forms the thumbwheel portion of said thumbwheel screw.

6. A knife and sheath combination as defined in claim 4, wherein said back portion of said sheath defines a recess for receiving said engagement member of said clamping arm upon said clamping arm adjustment member biasing said first end of said clamping arm away rom said back portion of said sheath.

7. A knife and sheath combination as defined in claim 1, further comprising longitudinally extending guideways provided in said receiving passage of said sheath for guiding said blade portion into said receiving passage.

8. In a combination article-sheath assembly, a retention device for clamping said article to said sheath, said retention device comprising; including at least one receiver projecting outwardly form the sheath; a clamping arm having a first end and a second end, said first end of said clamping arm being pivotally connected to said receiver for pivotal movement with respect to the sheath; said second end of said clamping arm including an engagement portion projecting outwardly from said second end of said clamping arm and towards the sheath; said first end of said clamping arm defining a threaded bore adjacent said receiver and opposite said second end of said clamping arm; a threaded adjustment member threadingly engaging said threaded bore; said threaded adjustment member having an enlarged purchase portion positioned between said first end of said clamping arm and the sheath and contacting the sheath for allowing selective biasing of said engagement member from a position between said engagement member and said sheath through rotation of said enlarged portion, thereby allowing biasing of said engagement member towards the sheath for gripping an article therebetween and for retaining the sheath on the article.

9. A clamping device as defined in claim 8, wherein said threaded adjustment member is a thumbwheel screw, and wherein said enlarged portion of said threaded adjustment member forms the thumbwheel portion of said thumbwheel screw.

10. A knife and sheath combination, the sheath being usable in association with an article, the knife and sheath combination comprising:

a knife having a blade portion and a handle portion which are unitary; said handle portion being adjacent said blade portion; said handle portion being of substantially the same thickness as said blade portion adjacent thereto and defining a grip receiving opening and an elongated tab member receiving opening passing through said handle portion and adjacent said grip receiving opening; at least one grip member for receipt in said grip receiving opening; at least one flexible elongated tab member for receipt and movement in said tab member receiving opening, said tab member having a first end adjacent said grip member and a second end opposite said first end of said tab member, said second end of said tab member being cantilevered and free to move with respect to said handle portion; and a tab projection connected to said tab member extending outwardly from said handle portion; said handle portion further defining a tab member receiving opening adjacent said grip receiving opening, said tab member receiving opening being for receipt of said tab member and for allowing movement of said tab member therein;

a sheath having a front portion, a back portion opposite said front portion, and first and second side portions opposite one another and each being connected to said front and back portions; said front and back portions and said first and second side portions together defining a blade receiving passage; said back portion having a frontal surface adjacent said receiving passage and a rearward surface opposite said frontal surface; said front portion defining a tab projection opening for receiving said tab projection of said tab member of said knife, so that when said blade portion is inserted into said blade receiving passage, said tab projection releasably engages said tab projection opening to retain said knife in said sheath; and sheath retention means connected to said back portion of said sheath for selectively retaining said sheath to an article; said sheath retention means including at least one receiver projecting outwardly from said back portion; a clamping arm having a first end and a second end, said first end being pivotally connected to said receiver for pivotal movement with respect to said back portion of said sheath; said second end of said clamping arm including an engagement portion projecting outwardly from said second end of said clamping arm and towards said rearward surface of said back portion of said sheath; said first end of said clamping arm defining a threaded bore adjacent said receiver and opposite said second end of said clamping arm; a threaded adjustment member threadingly engaging said threaded bore; said threaded adjustment member having an enlarged portion positioned between said first end of said clamping arm and said rearward surface of said back portion and contacting said rearward surface of said sheath upon selective rotation of said enlarged portion, thereby biasing said engagement member towards said rearward surface of said back portion for gripping an article therebetween and for retaining the sheath on the article.

11. A knife and sheath combination as defined in claim 10, further comprising said back portion of said sheath defining at least one strap receiving opening for receiving a strap therein.

12. A knife and sheath combination as defined in claim 10, wherein said threaded adjustment member is a thumbwheel screw, and wherein said enlarged portion of said threaded adjustment member forms the thumbwheel portion of said thumbwheel screw.

13. A knife and sheath combination as defined in claim 10, wherein said back portion of said sheath defines a recess for receiving said engagement member of said clamping arm upon said clamping arm adjustment member biasing said first end of said clamping arm away from said back portion of said sheath.

14. A knife and sheath combination as defined in claim 10, further comprising longitudinally extending guideways provided in said receiving passage of said sheath for guiding said blade portion into said receiving passage.

* * * * *